United States Patent [19]

Igarashi

[11] 4,252,262

[45] Feb. 24, 1981

[54] METHOD FOR MANUFACTURING A GOLF CLUB

[76] Inventor: Lawrence Y. Igarashi, 3122 W. Alpine Ave., Santa Ana, Calif. 92704

[21] Appl. No.: 939,270

[22] Filed: Sep. 5, 1978

[51] Int. Cl.[3] ..... A63B 53/04

[52] U.S. Cl. ..... 228/174; 273/167 J; 273/173

[58] Field of Search ..... 228/174; 273/173, 167 J, 273/175, 167 R, 167 A, 167 B, 167 C, 167 D, 167 E, 167 F, 167 G, 167 H, 167 K, 168, 77 R, 77 A

[56] References Cited

U.S. PATENT DOCUMENTS

| | | | |
|---|---|---|---|
| D. 137,814 | 5/1944 | Newsome | 273/167 D |
| 1,289,553 | 12/1918 | Sanders | 273/173 |
| 1,562,956 | 11/1925 | Guerne | 273/173 |
| 1,567,248 | 12/1925 | Dahlman | 273/173 |
| 4,027,885 | 6/1977 | Rogers | 273/173 |

FOREIGN PATENT DOCUMENTS

| | | | |
|---|---|---|---|
| 455632 | 10/1936 | United Kingdom | 273/167 A |

*Primary Examiner*—Daniel C. Crane

*Attorney, Agent, or Firm*—Harold C. Horwitz

[57] ABSTRACT

A method for the manufacture of golf clubs of the iron or wood types having the characteristic of improved driving power. This characteristic of greater driving power results from the manufacture of the golf clubs with a flexible striking face. The flexible striking face is designed to vibrate in simple harmonic motion of the same frequency as the struck golf ball. The flexible striking face design is such that the frequency of vibration of the striking face is constant across its face and the amplitude of vibration is constant across its face and, as a consequence thereof, the restoring force of the resilient face combines with the restoring force of the struck golf ball to impart a greater distance to the drive. The method of manufacture comprises casting a head having a neck and body dependent thereon and providing the body with an open cavity behind its face that extends from one edge thereof across a substantial portion of the face. The striking face plate may be integrally formed with the body of the club at the time of casting or it may be secured thereto by fusing the periphery of the face plate to the body of the club.

8 Claims, 5 Drawing Figures

FIG. 1
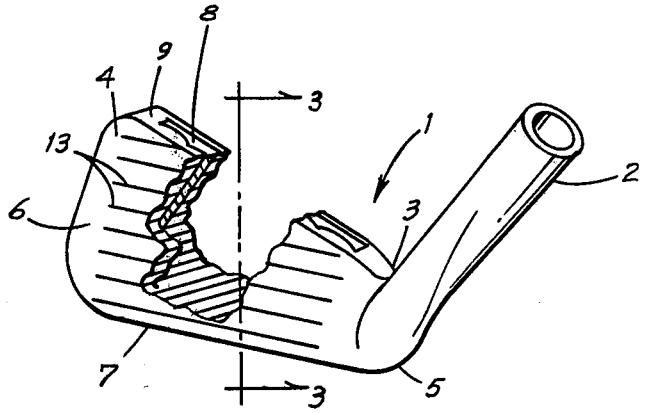
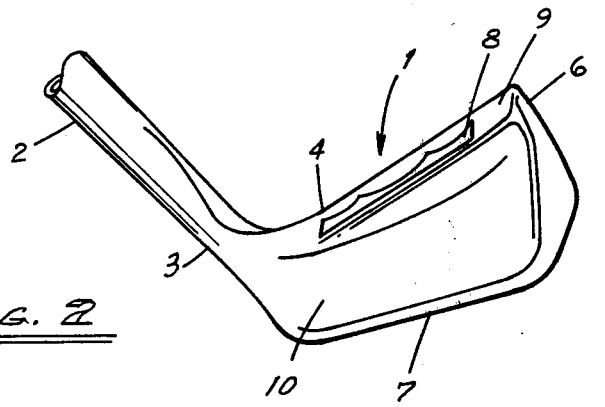
FIG. 2
FIG. 3
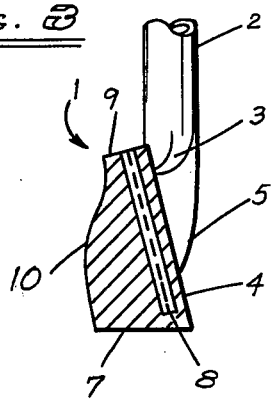
FIG. 4
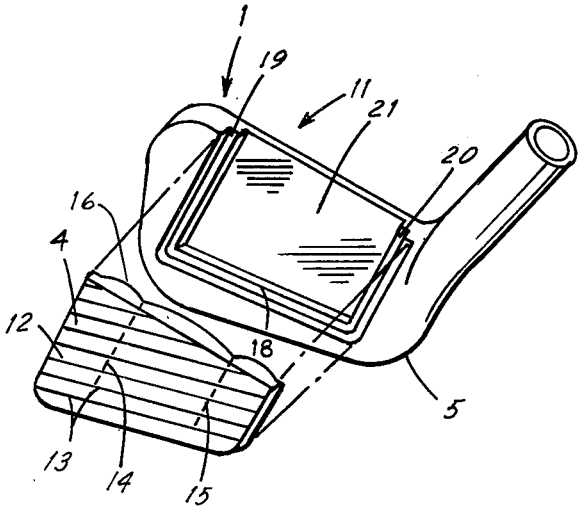
FIG. 5
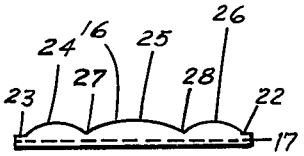

METHOD FOR MANUFACTURING A GOLF CLUB

BACKGROUND OF THE INVENTION

1. Field of the Invention

This invention relates to golf clubs of the wood or iron type and, in particular, to a method of manufacture of a golf club having an improved driving range.

2. Description of the Prior Art

Golf clubs are conventionally manufactured as a solid metal casting in the case of 'irons' or as a solid wood head in the case of 'woods'. The clubs have numbers associated with them, the higher the number the greater the inclination of the striking face to the horizontal plane and the shorter the shaft.

The conventional club does not obtain maximum possible driving distance because there is generally no designed relationship of the frequency of the vibration of the striking face to the frequency of vibration of the golf ball. As a consequence, the frequency and the kinetic energy of the vibrating face plate is dissipated in vibrations transferred to the head and shaft, with only a portion of the vibration energy transferred to the ball. This characteristic not only fails to optimize the driving power of the club but also tranfers unpleasant shaft vibrations to the golfer.

SUMMARY OF THE INVENTION

The method of manufacture of this invention comprises forming a head having a neck and body dependent thereon with an open cavity formed in the body of the head and extending across a substantial portion of the face. There are formed face plate grooves along three edges of the cavity, which grooves form a seat upon which the face plate is seated. The cavity is closed upon placement of the face plate on the grooves, and the face plate is thereafter secured to the body by fusing it thereto. An alternate embodiment of the invention comprises the casting of the head in one piece with the requisite face characteristics. The natural frequency of the face plate is designed to match the natural frequency of the struck golf ball, and in a typical club, would have one or more arcuate surfaces defined on the interior of the strike face such that the frequency and amplitude of the vibration are constant across its face. A typical 5.0 centimeters long strike plate would have three arcuate surfaces, the center surface approximately 2.5 centimeters long having minimum and maximum thicknesses of approximately 3 and 4 millimeters, respectively, the end surfaces 1.25 centimeters long and having minimum and maximum thicknesses identical to the center surface. Slot thickness would be 2.5 to 3.5 millimeters at its minimum and maximum thickness points, respectively.

BRIEF DESCRIPTION OF THE DRAWINGS

FIG. 1 is a perspective front view of a portion of an 'iron' golf club of the invention.

FIG. 2 is a perspective back view of an 'iron' golf club of the invention.

FIG. 3 is a sectional view of the golf club of FIG. 1 taken along the line 3—3 thereof.

FIG. 4 is an exploded view of the 'iron' golf club of the invention.

FIG. 5 is a top view of the strike plate of the invention.

DESCRIPTION OF THE PREFERRED EMBODIMENTS

The preferred embodiment of the invention is shown in FIG. 1, with head 1 secured to shaft (not shown) which is inserted into neck 2. Reduced diameter of neck 3 provides an unobstructed view of the face 4 presenting a generally flat striking surface. Heel 5 is opposite toe 6 and a generally flat bottom surface 7 is therebetween. Cavity 8 extends across a substantial portion of face 4.

The head of the club is shaped to provide a low center of gravity with the head having a thin top edge 9 and an inclined near wall 10.

The cavity 8 comprises an internal cavity extending from edge surface 9 and is continuous over a substantial area of face 4. As shown in the preferred embodiment, the cavity is bounded by a substantially flat surface 21, grooves 18, 19, and 20, and the surface 16, opposite face 4. The cavity is approximately 5.0 centimeters long and 3.5 millimeters wide at its widest point and 2.5 millimeters wide at its narrowest point. Cavity boundary 16 is defined by partial cylindrical surfaces 24, 25 and 26 intersecting along lines 27 and 28. Cylindrical surface 25 is approximately 2.5 centimeters wide and cylindrical surfaces 24 and 26 are approximately 1.25 centimeters wide.

The invention comprises a method for manufacture of the head for a golf club. The method of manufacture is illustrated in FIG. 4 where the head 1, in the disclosed embodiment, is shown to be formed of two piece construction, the body 11 and the face plate 12. In an alternate method of manufacture (not shown), the head 14 would be of a one piece, cast construction.

Grooves 18, 19 and 20 shown in FIG. 4 serve as mounting edges for face plate 4, which is prepared to have a minimum thickness of 3 millimeters and a maximum thickness of 4 millimeters. Face plate edges 22 and 23 fit on grooves 20 and 19 and face plate edge 17 is seated on groove 18. Backside 16 of face 4 is comprised of cylindrical surfaces 24, 25, and 26 which surfaces intersect along lines 14 and 15. The face plate 12 geometry yields a vibration frequency equal to the vibration frequency of a struck golf ball. The face plate design also yields a restorative force, when struck by a golf ball, of approximately equal amplitude across its face.

The face plate design can be modified dimensionally to accomodate wooden club adaptation (not shown), and such design would use conventional fastening means to fasten the metal face plate to the wooden head.

The invention has been described by references to the preferred embodiment. It is not intended that the invention be unduly limited by the description of the preferred embodiment. It is intended that the invention be defined by the steps and means and their obvious equivalents.

I claim:

1. A method for the manufacture of a golf club head having improved driving power which comprises the following steps:

casting a head having a neck and body dependent thereon of the shape and size generally characteristic of a golf club head defined by sides, face, back, top edge and bottom edge, while providing an open cavity in the face of said body which cavity extends from the top edge of said body across a substantialportion of said face;

forming faceplate grooves along three cavity edges;

preparing a solid metal plate having grooves along three edges, a flat face and an opposite face defined by three partial cylindrical surfaces intersecting along parallel axes, wherein said metal plate is dimensioned so as to have a resonant frequency equal to that of a struck golf ball, and axes of said cylindrical surfaces are located to yield constant amplitude of vibration across said face;

placing said metal plate in said grooves with the opposite face disposed in the cavity and thereby closing said fact to said cavity; and, fusing said metal plate about its periphery to said head body.

2. The method of claim 1 wherein said cavity extends from a point below the top edge of said body to the bottom edge of said body.

3. The method of claim 1 wherein said cavity extends to the bottom of said body.

4. The method of claim 1 wherein said metal plate is approximately 5.0 centimeters long and from approximately 3 millimeters to 4 millimeters thick.

5. The method of claim 1 wherein said body is of one piece construction formed by casting process.

6. The method of claim 5 wherein said cavity extends from a point below the top edge of said body to the bottom edge of said body.

7. The method of claim 5 wherein said cavity extends to the bottom of said body.

8. The method of claim 5 wherein said metal plate is approximately 5.0 centimeters long and from approximately 3 millimeters to 4 millimeters thick.

* * * * *